US010352591B2

(12) United States Patent
Jassani et al.

(10) Patent No.: US 10,352,591 B2
(45) Date of Patent: Jul. 16, 2019

(54) COOLING DEVICE AND METHOD THEREFORE FOR CO2 WASHING MACHINE

(75) Inventors: Ahmed Al Jassani, Cairo (SE); Hakan L. Karlsson, Annerstad (SE); Sten Hakan Almstrom, Ljungby (SE)

(73) Assignee: Electrolux Laundry Systems Sweden AB, Ljungby (SE)

( * ) Notice: Subject to any disclaimer, the term of this patent is extended or adjusted under 35 U.S.C. 154(b) by 872 days.

(21) Appl. No.: 13/700,201

(22) PCT Filed: May 27, 2011

(86) PCT No.: PCT/EP2011/058706
§ 371 (c)(1),
(2), (4) Date: Jun. 7, 2013

(87) PCT Pub. No.: WO2011/147954
PCT Pub. Date: Dec. 1, 2011

(65) Prior Publication Data

US 2015/0168023 A1 Jun. 18, 2015

(30) Foreign Application Priority Data

May 28, 2010 (SE) ..... 1000576

(51) Int. Cl.
*F25B 1/10* (2006.01)
*D06F 43/08* (2006.01)

(52) U.S. Cl.
CPC ..... *F25B 1/10* (2013.01); *D06F 43/08* (2013.01); *F25B 2400/072* (2013.01)

(58) Field of Classification Search
CPC ..... D06F 43/081; D06F 43/08; F25B 1/10; F25B 9/008; F25B 2400/051; F25B 2400/054; F25B 2400/072; F25B 2400/13
See application file for complete search history.

(56) References Cited

U.S. PATENT DOCUMENTS

| | | | | |
|---|---|---|---|---|
| 2,497,450 | A * | 2/1950 | Gygax | 62/120 |
| 4,984,318 | A * | 1/1991 | Coindreau-Palau | 8/158 |
| 5,970,554 | A * | 10/1999 | Shore et al. | 8/158 |
| 2003/0177782 | A1* | 9/2003 | Gopalnarayanan et al. | 62/505 |
| 2004/0255394 | A1 | 12/2004 | Mani | |
| 2005/0044865 | A1* | 3/2005 | Manole | 62/149 |
| 2005/0132729 | A1* | 6/2005 | Manole | F25B 1/10 62/149 |

(Continued)

FOREIGN PATENT DOCUMENTS

| | | |
|---|---|---|
| DE | 3038789 | 4/1982 |
| EP | 1693501 | 8/2006 |

OTHER PUBLICATIONS

International Search Report for PCT/EP2011/058706, dated Dec. 20, 2012, 2 pages.

*Primary Examiner* — Christopher R Zerphey
(74) *Attorney, Agent, or Firm* — Pearne & Gordon LLP

(57) ABSTRACT

The present invention relates to a cooling unit for cooling fluid in a dry cleaning system and a method therefore. The cooling unit (12) comprises a device (1, 7, 8) containing cooled fluid such as carbon dioxide, and a tube section (11) for conveying the fluid from a first compressor stage (2) to a second compressor stage (3), arranged so that the fluid in the tube section (11) is cooled by the cooled fluid in the device (1, 7, 8).

14 Claims, 5 Drawing Sheets

(56) References Cited

U.S. PATENT DOCUMENTS

| | | | | |
|---|---|---|---|---|
| 2006/0225459 | A1* | 10/2006 | Meyer | F25B 40/02 62/512 |
| 2008/0256975 | A1* | 10/2008 | Lifson et al. | 62/510 |
| 2010/0326100 | A1* | 12/2010 | Taras | F25B 1/10 62/115 |
| 2013/0167558 | A1* | 7/2013 | Jassani et al. | 62/56 |

* cited by examiner

COOLING DEVICE AND METHOD THEREFORE FOR CO2 WASHING MACHINE

FIELD OF THE INVENTION

The present invention relates to dry cleaning systems namely washing machines using dry solvents such as carbon dioxide. In particular the present invention relates to a cooling device and method for cooling solvents being used in such systems.

BACKGROUND OF THE INVENTION

Washing systems using dry solvents such as carbon dioxide have been known for several years. In recent years this technology has become more popular mainly due to the environmental advantages compared to other washing systems using different solvents. Known dry cleaning systems usually contain a cleaning chamber wherein e.g. fabrics are cleaned, a distiller for separating the carbon dioxide from contaminants so that the carbon dioxide can be reused, a storage tank for storing the carbon dioxide when not in use for cleaning, a cooling unit, and a compressor for moving solvent in the system and building up a pressure in the system.

One example of such a system is disclosed in EP 1842602, which discloses a multiple bath CO2 system wherein the system and method is designed for processing parts in more than one bath of dense phase carbon dioxide. The system disclosed in EP1842602 is designed to work within a temperature interval between 10-20° C. which corresponds to a pressure around 58 bar.

Currently the trend in this technology goes towards increasing the pressure in these systems in order to achieve advantages in the cleaning properties of the solvent being used. Even though EP 1842602 disclosed that higher temperatures and pressures could be used, there is no teaching how this can be done.

One known way to increase pressure is to use two compressors as illustrated in FIG. 1. When using a multi-stage gas compressor in a CO2 washing machine there is a need of intercooler, because when transporting the gas the gas pressure is increased and the gas temperature increase almost exponential, and might reach levels that are critical for the compressor so there is a risk that the compressor is damaged.

Thus, FIG. 1 of the present application, illustrates a system having two compressors wherein the second compressor (3) is used to further increase the pressure after a first compressor stage (2) has compressed the gas once. In order to avoid this temperature increase, a cooling unit (23), which is an air cooled intercooler, having flanges and a fan (5), has been arranged between the first (2) and second (3) compressor stages as illustrated in FIG. 1.

However a drawback with the prior art cooling system is that it is rather complex with moving parts, and that it needs a power source of electrical energy in order to function. Another drawback with the prior art systems is that the cooling unit needs to be controlled. The fan is either constantly operating, or the fan has to be synchronized with the compressor so that it runs when the compressor is operating. None of the solutions are good, since the fan will either constantly use electrical energy or it needs to be controlled, still needing electrical energy when operating.

In general, a system being more complex and having more mechanical moving parts is more likely to fail and thus shortens the time between maintenance, which in the end may lead to periods wherein the system can not be used, and even further in the long run increased costs. Another drawback with such prior art system is that the cooling unit in it self is very expensive which increases the total cost of the whole system.

A further drawback with prior art systems is that fluid stored in the storage tank is supercooled in order to avoid a too high pressure in the storage tank. During operation of the system this may become a problem because when the system is running the fluid is cooled between each washing cycles when transferred back to the storage chamber, this leads to a too cool fluid (supercooled fluid) in the storage tank, so that when the fluid is transferred to the next washing cycle the fluid does not have optimal temperature for washing.

BRIEF DESCRIPTION OF THE INVENTION

Thus it is an object of the present invention to provide an improved dry cleaning apparatus.

It is another object of the present invention to provide a more energy efficient dry cleaning apparatus.

It is another object of the present invention to provide an improved cooling unit.

It is another object of the present invention to provide an energy efficient cooling unit for a gas compressor.

It is yet another object of the present invention to provide a technical solution that is simple and cheap.

It is even a further object of the present invention to provide a solution that is automatically actuated without the need of synchronization.

According to a first aspect of the invention the above object and others are achieved by providing an apparatus for cleaning articles comprising a first compressor stage for processing of fluid, a second compressor stage for further processing of the fluid, and a cooling unit arranged between the first and second compressor stage for cooling the fluid, characterised in that the cooling unit comprises a device containing cooled fluid, and a tube section for conveying the fluid from the first compressor stage to the second compressor stage, arranged such that the fluid in the tube section is fluidly associated with the fluid in the device and cooled by the cooled fluid in the device.

By having a cooling unit according to the present invention, wherein the fluid is cooled by cool fluid in other parts of the system, provides numerous advantages. For example there is no need to provide extra energy to the cooling unit such as electrical energy. Thus the cooling effect is obtained from already cooled parts in the system. The cooled fluid in other parts of the system is fluidly associated with the fluid in the tube section via the tubes, hence it is the same fluid as the fluid in the tube section but at different process stages in the apparatus. Since the part cooling the fluid will absorb heat from the fluid the temperature will increase in this part. However this temperature increase is small.

A further advantage with this temperature increase of the cooled fluid in the device is that the present invention counteracts the supercooling of the cooled fluid that may have occurred during continuous operation of the apparatus. The temperature increase is due to the transfer of heat from the fluid in the tube section between the compressor stages to the cooled fluid in the device, thereby a much more optimal temperature of the cooled fluid can be achieved for use in a subsequent washing process and the energy within the system can thereby be used.

Another advantage is that the present invention provides a simpler solution wherein fewer moving parts are needed, since the air cooling unit can be removed, which for example minimizes the need for service. Even a further advantage is that there is no need for synchronising the cooling unit since the fluid will automatically be transferred via the cool fluid in the other parts of the system. Due to the simplicity of the present invention it is much cheaper compared to prior art solutions.

The compressor unit being used in relation to the present invention is preferably a multi-stage compressor having two or more compressor stages, also referred to as two-stage compressor or three-stage compressors. However two or three separate compressors could also be used, which would result in a more bulky solution and also more expensive solution, therefore at present such a solution is less attractive.

The cooling unit according to the invention comprises two parts, namely a device containing cooled fluid and a tube section for conveying the fluid as mentioned above. The device containing cooled fluid could for example be a storage device or the cleaning chamber or the distiller. Other devices in the system could also be used as long as it contains cooled fluid. The tube section is preferably made of stainless steel but could of course be in any material that is suitable for transferring heat.

Preferably the tube section is arranged inside the device so that the distance from the fluid being used to cool the fluid in the tube section is minimized. Furthermore it has the advantage that the tube section can be contacted from all directions by the cool fluid which would result in a more efficient cooling.

In another embodiment according to the invention the tube section is arranged on the outside of the device. In this way the tube section is easier to access and the tube section as well as the device can independently be replaced if necessary. Furthermore it may be easier to manufacture the devices having the tube section on the outside. Any insulation can be mounted after the tube section has been arranged on the device.

Preferably the tube section is about 0.2 to about 2 meter long. The length of the heat exchanging tube section is dependent on which device it is arranged in. For example if the tube section is arranged in the distiller the length may be 0.2 meter. If the tube section is arranged in the storage device the preferred length is about 0.5 meter. If, on the other hand the tube section is arranged in the cleaning chamber the preferred length is about 2 meters. This is due to the difference in cooling effect each device provides.

According to a second aspect of the invention, the above and other objects are fulfilled by a method for cooling fluid being used as a solvent in a dry cleaning system, the method comprising the steps of: compressing the fluid in a first step, compressing the fluid in a second step, cooling the fluid, characterised in that the cooling step comprises the step of conveying the fluid via cool fluid so that the fluid is cooled by the cooled fluid.

An advantage achieved by this is that it removes the need of additional external energy in order to operate a mechanical cooling unit such as a fan. The method according to the present invention takes advantage of, and uses differences in temperature between different internal parts of the system. Thus the cooled fluid in one of the devices as mentioned above can therefore be used to cool the fluid between the compressing steps.

The method may further comprise the step of cooling the fluid in a second cooling step. For example the fluid is cooled once more before conveying the cooled fluid to storage. Or it could be a second intermediary cooling step between the second compressor stage and a third compressor stage if the compressor unit is a 3 stage compressor.

The method may further comprise the step of conveying the cooled fluid to a cleaning chamber. Thereby articles such as fabrics can be cleaned in the cleaning chamber and the fluid in the cleaning chamber can be used for cooling the fluid.

Furthermore the method may comprise the step of conveying the cooled fluid to a distillation vessel. The process in the distillation vessel does also have a cooling effect and therefore can be used to cool the fluid between the compressing steps.

The pressure of the fluid in the system is between 20 to 100 bar. Preferably the pressure of the fluid is such so that the fluid is in gas phase. According to a preferred embodiment the pressure is about 52-61 bar after compressing the fluid in the second step. However other pressures may be suitable, such as between 50 to 70 bar, or 70 bar and above. However increased pressure also increases the requirements on mechanical structures in the system, such as bolts, hinges, locks, pipes and so forth. These parts and others need to be dimensioned and constructed so as to withstand this increased pressure.

The fluid used in the system and method mentioned above preferably comprises carbon dioxide. However other dry solvents may also be used, or combinations of solvents.

According to a third aspect of the invention, the above mentioned object and other objects are fulfilled by a cooling system comprising a compressor unit for sequential compression of a fluid, a cooling unit for intermediary cooling of the fluid between the sequential compressions, Characterised in that the cooling unit comprises a storage of cooled fluid and in that the compressor unit and cooling unit are interlinked in such a way that intermediary cooling is made by the stored cooled fluid.

An additional advantage achieved according to the third aspect is that the cooling system could be used in other applications or contexts such as for example when delivering carbon dioxide fluid to a cleaning system having a higher pressure than the delivery vessel have, or when filling a delivery vessel with carbon dioxide.

Similar to before the compressor unit is preferably at least a two stage compressor. However it could also be a three stage compressor or two independent compressors serially arranged.

These and other aspects of the invention will be apparent from and elucidated with reference to the embodiments described hereinafter.

Figures are preferably schematically drafted in order to facilitate understanding. Therefore other designs that could be drafted in the same schematic way are implicitly also disclosed in this document.

DESCRIPTION OF PREFERRED EMBODIMENTS

Figure 1:
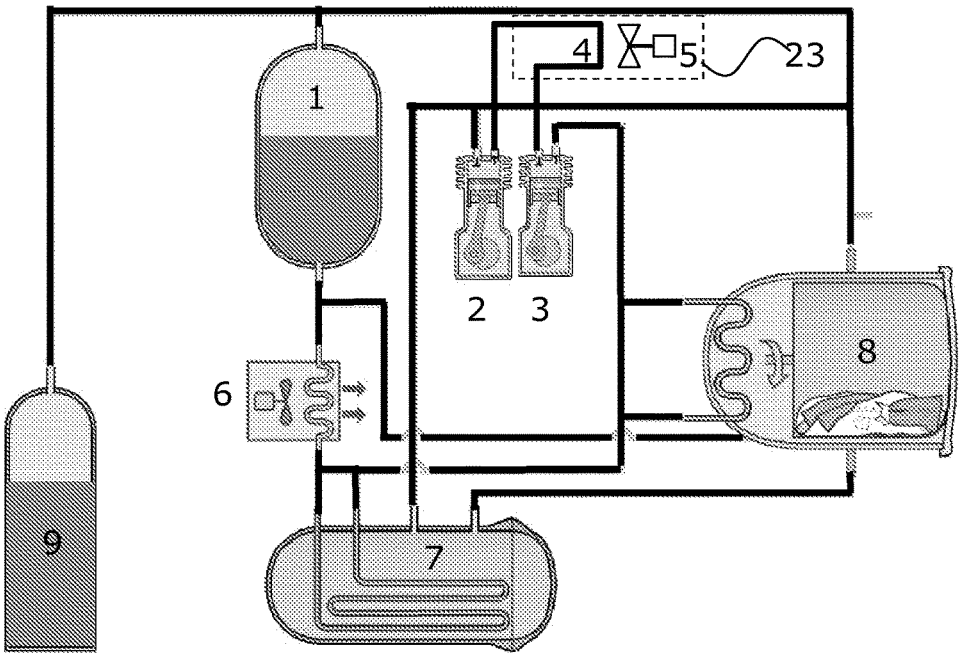
Fig. 1 Prior art
FIG. 1 illustrates a prior art system having a mechanical cooling unit.

FIG. 1 illustrates a prior art dry cleaning system comprising a storage device 1, a compressor having two compressor stages 2 and 3, a cooling unit 23 comprising a tube section 4 and an air cooled intercooler 5. The system further comprises a distiller 7 and a cleaning chamber 8 for cleaning fabrics, a refilling tube 9 and a second cooling unit 6 for cooling fluid before the fluid enters the storage device 1.

Figure 2:
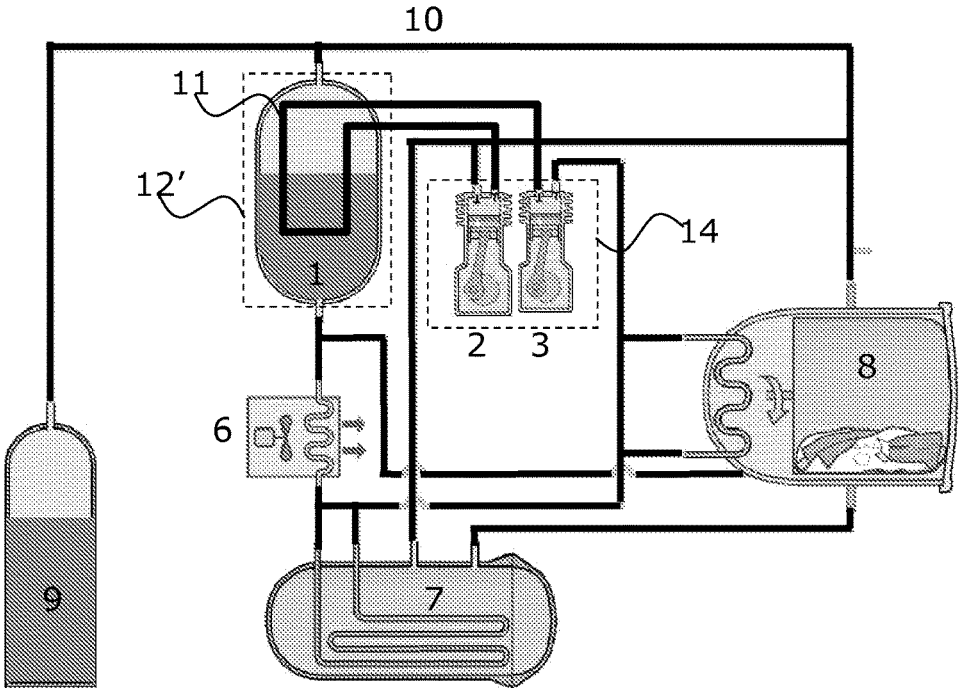
FIG. 2 illustrates an embodiment of the present invention wherein the cooling unit comprises a storage device for cooling the fluid.

FIG. 2 illustrates a first embodiment according to the present invention wherein a cooling unit 12' comprises a tube section 11 and a storage device 1. As can be seen from FIG. 1 the first compressor stage 2 is used for compressing the fluid a first time, thereafter the fluid is conveyed via the tube section 11 to the second compressor stage 3 in the compressor unit 14 for a second compression. Once the fluid has passed through both compressor stages, and the intermediate cooling unit 12', it can for example be transferred to the storage device 1 via a second cooling unit 6. It can also be conveyed via the cleaning chamber 8 to provide heat to the cleaning chamber 8 before being conveyed to the storage device 1 via the cooling unit 6. Another option is to convey the fluid after it has passed the two compressor stages via the distiller 7 and then to the storage device 1 via the second cooling unit 6.

According to a cleaning process the fluid is stored in the storage device 1, and upon start of the cleaning system, after a user have entered articles to be cleaned in the cleaning chamber 8, the fluid is transferred via the tubes to the cleaning chamber 8 containing the articles to be cleaned. After a cleaning program has been executed the cleaning chamber 8 is emptied from fluid via the tubes connected to the distiller 7. In the distiller the fluid evaporates in to gas and leaves any contaminant in the distiller 7. The distiller comprises a valve so that contaminants can be removed from the distiller 7 via the valve. After the distiller, the fluid is transferred to the compressor unit 14 for compression, in the multi-stage compressor, to a working pressure of the system. After the compression the compressed fluid having an increased pressure and temperature is transferred via the tubes to the storage device 1. On the way to the storage device 1 the fluid may pass the distiller 7 so that the heat in the compressed fluid can be used to evaporate the fluid in the distiller. Before the fluid enters the storage device it usually passes a cooling unit 6.

Figure 3:
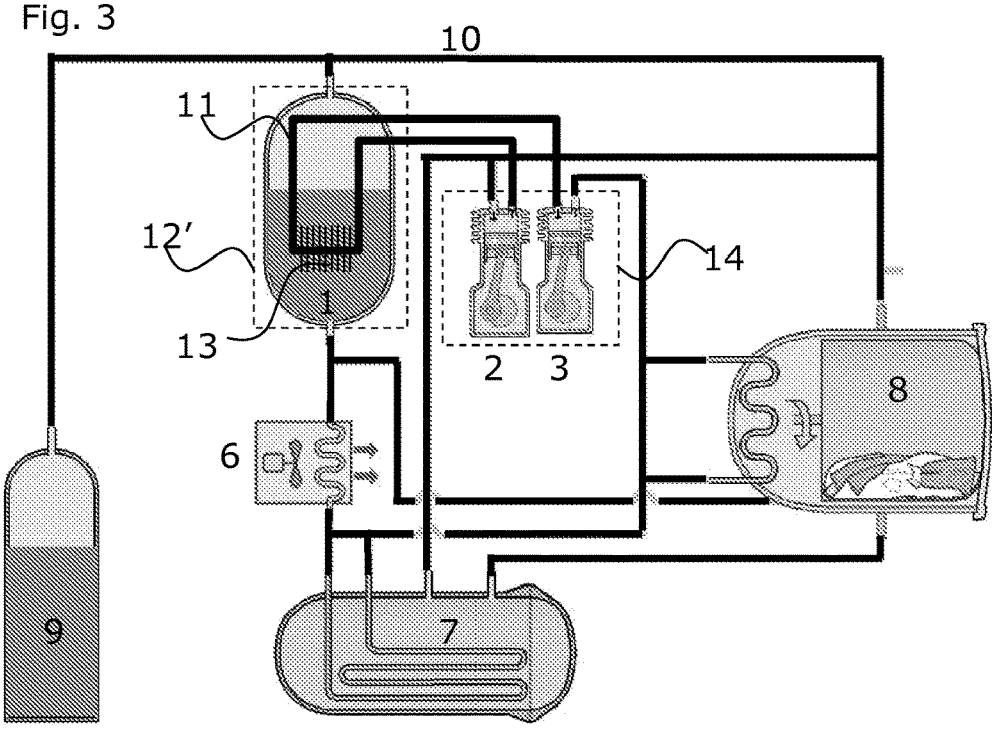
FIG. 3 illustrates an embodiment wherein flanges are arranged to the tube section in the cooling unit.

FIG. 3 illustrates a further embodiment of the present invention wherein the tube section 11 in the cooling unit 12' comprises flanges 13 in order to further improve the cooling effect in the storage device 1. By having the flanges the contact surfaces between the cooling fluid and the fluid to be cooled is increased and more efficient cooling is achieved. The arrangement of flanges on the tube section 11 can be used in all embodiments of the present invention.

Figure 4:
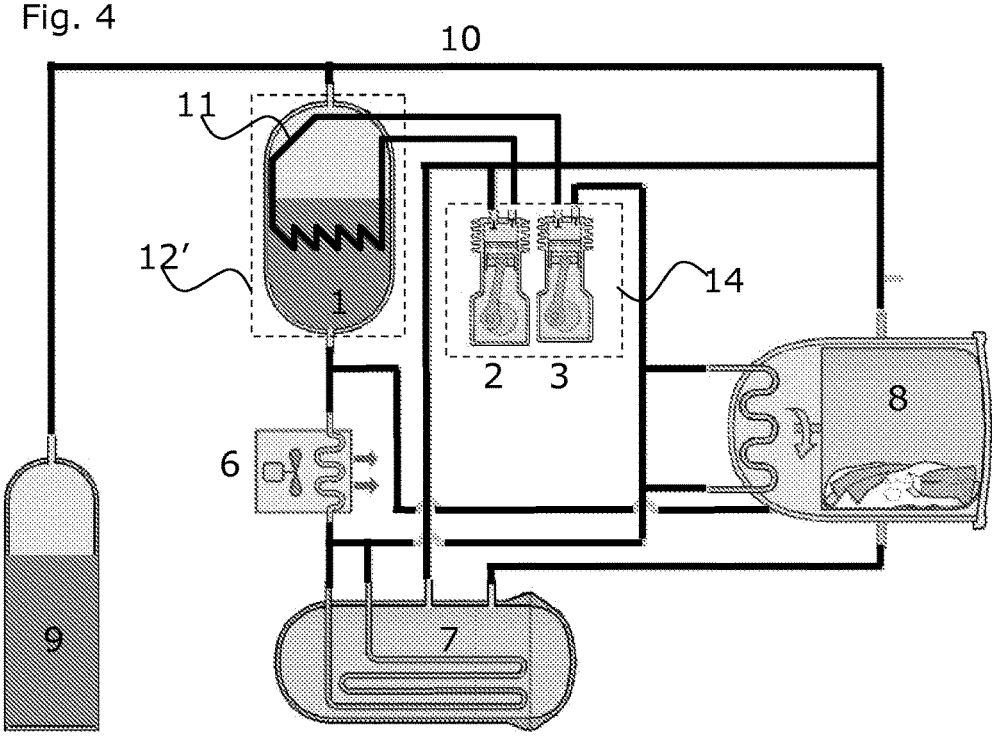
FIG. 4 illustrates an embodiment wherein the tube section is folded or winded in the cooling unit.

FIG. 4 illustrates a further embodiment of the present invention similar to the one in FIG. 3, but instead of flanges the tube section in itself is configured so that the contact surface between the cooling fluid and the fluid to be cooled is increased and thereby more efficient cooling can be achieved. For example the tube section can have a serrated form or circular windings inside the storage device 1. This design on the tube section 11 is applicable to any of the embodiments of the present invention.

Figure 5:
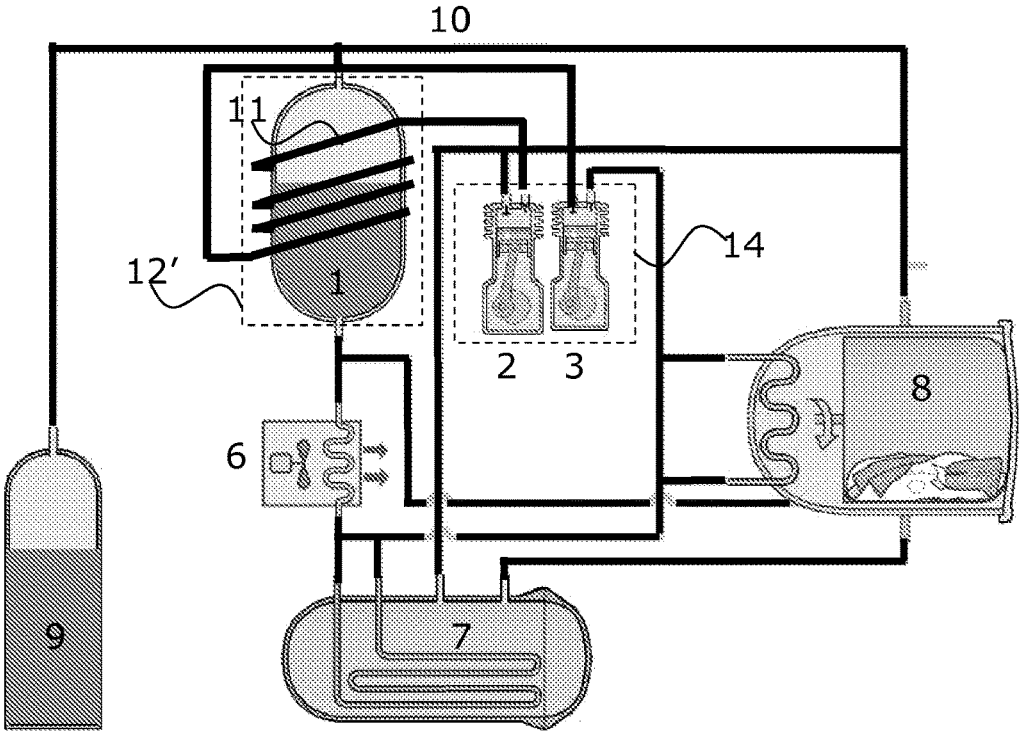
FIG. 5 illustrates an embodiment of the present invention wherein the tube section is arranged on the outside of the storage device.

FIG. 5 illustrates another embodiment of the present invention wherein the tube section in the cooling unit 12' is arranged on the outside of the device 1 containing the cooling fluid. In this particular embodiment illustrated in FIG. 5 the tube section 11 is arranged on the storage device 1. However the tube section 11 can be arranged on the outside of any of the cleaning chamber 8 or the distiller 7.

Figure 6:
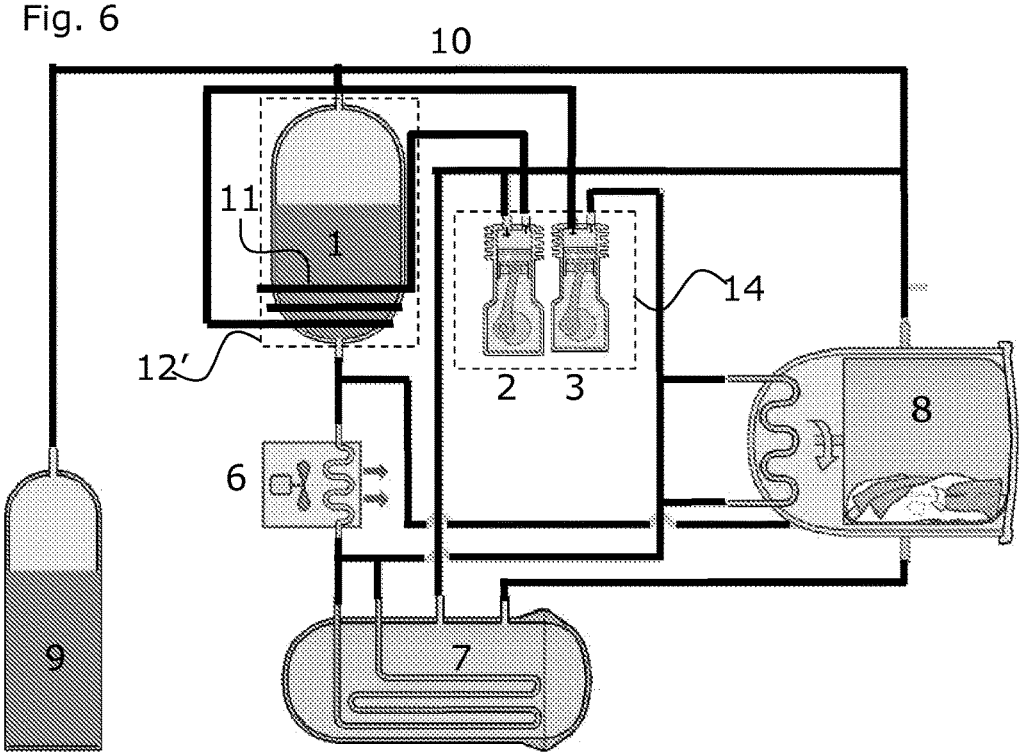
FIG. 6 illustrates an embodiment of the present invention wherein the tube section is arranged on the lower part on the outside of the storage device.

FIG. 6 illustrates another embodiment of the present invention wherein the tube section in the cooling unit 12' is arranged around the lower part of the storage device 1 containing the cooling fluid. By arranging the tube section 11 around the lower part of the storage device 1, a more efficient heat exchange can be achieved since the cool fluid in the storage device 1 can be in two phases, liquid and gas. The fluid in liquid phase is heavier than the fluid in gas phase and therefore collects in the bottom of the storage device 1. In this example illustrated in FIG. 6 it is the storage device 1, however this arrangement may be applicable to any of the embodiments of the present invention using the cleaning chamber 8 or the distiller 7.

Figure 7:
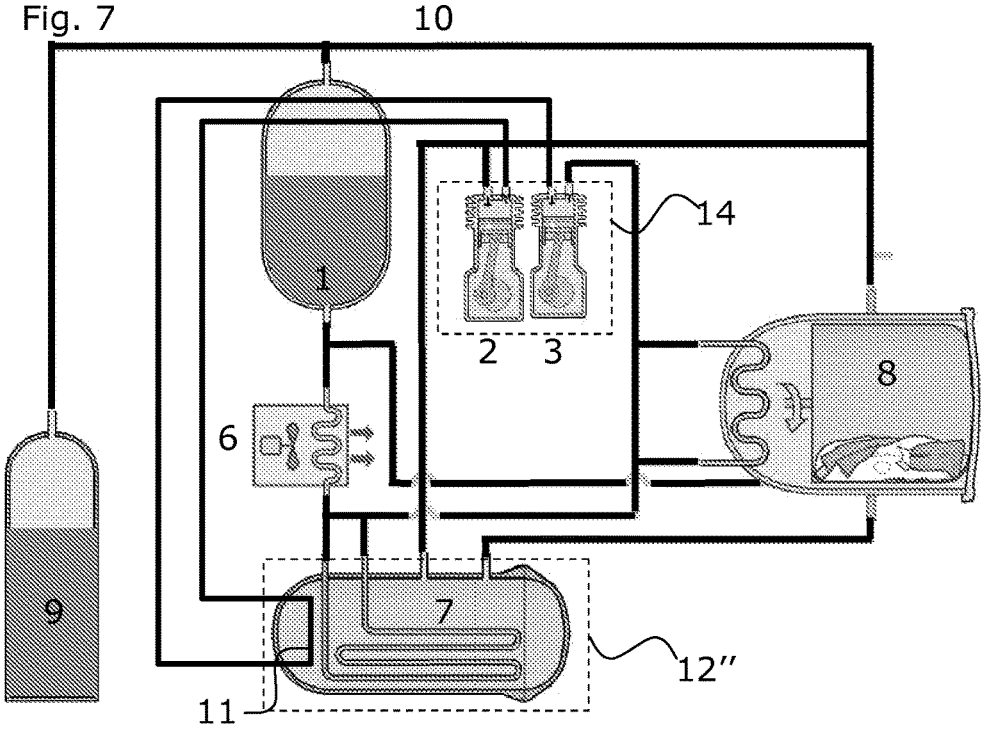
FIG. 7 illustrates an embodiment according to the present invention wherein the cooling unit comprises a distiller for cooling the liquid.

FIG. 7 illustrates a second embodiment of the present invention wherein the cooling unit 12' comprises a tube section 11 and a distiller 7. Since the distiller have higher efficiency compared to other devices in the system when it comes to cooling the length of the tube section 11 in the distiller 7 can be shorter compared to when the tube section 11 is arranged in for example the storage device 1.

Hence the length of the tube section 11 is dependent on if the tube section 11 is arranged in the storage device 1 or in the cleaning chamber 8 or in the distiller 7. It is also dependent on if the tube section is arranged on the outside or the inside of the devices 1, 7, 8. Trial have shown that the tube section may be between 0.2 and 2 meters long depending on which device 1, 7, 8, it is associated with, and if it is arranged on the inside or the outside. For example the tube section 11 is between 0.3 and 0.7 meter long if it is arranged in the storage device 1. Preferably it is about 0.5 meter long if it is arranged in the storage device 1. However it would be enough with a tube section 11 that is between 0.1 and 0.3 meter long if the tube section 11 is arranged in the distiller 7. Preferably the tube section is about 0.2 meter long if it is arranged in the distiller 7.

Figure 8:
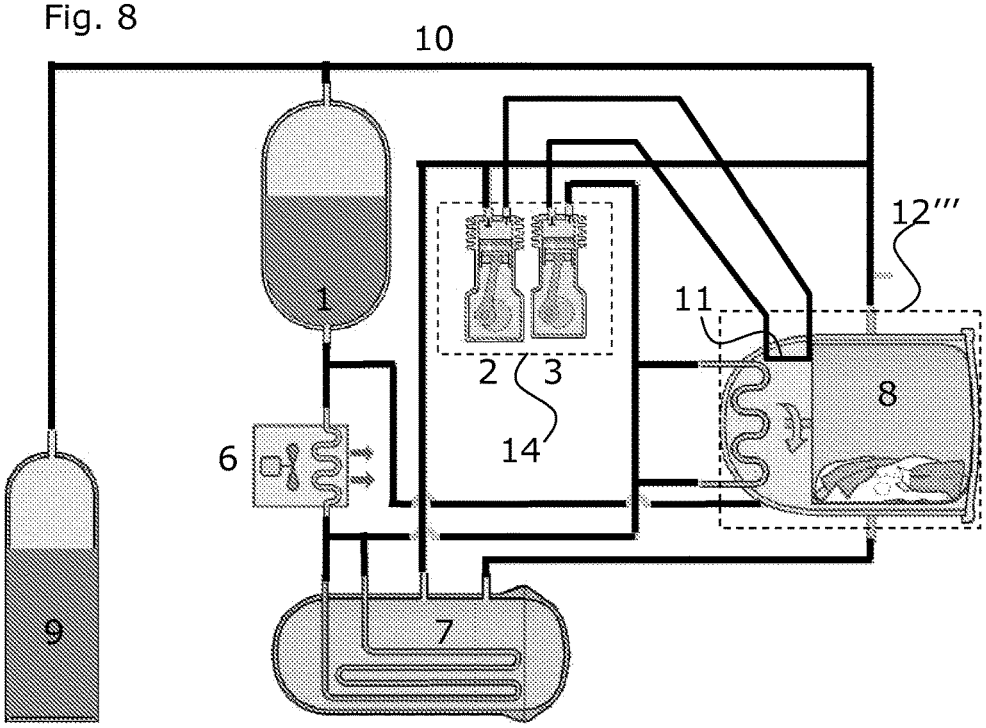
FIG. 8 illustrates an embodiment according to the present invention wherein the cooling unit comprises a cleaning chamber for cooling the liquid.

FIG. 8 illustrates a third embodiment according to the present invention wherein the cooling unit 12''' comprises a tube section 11 and a cleaning chamber 8 containing cool fluid for cooling the fluid in the tube section 11. Even though FIG. 8 illustrates the tube section 11 being arranged in the upper part of the cleaning chamber 8 it is only for illustrative purposes. Preferably the tube section 11 is arranged in the lower parts of the cleaning chamber 8 where the cool fluid is collected.

Figure 9:
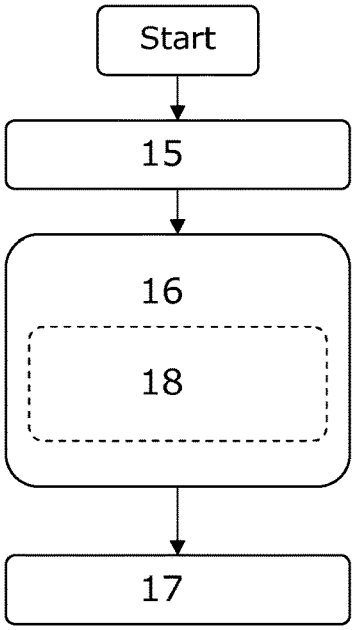
FIG. 9 illustrates a method according to the present invention.

FIG. 9 illustrates a method according to the present invention. The method comprises the steps of compressing the fluid in a first stage 15, thereafter cooling the fluid in a second step 16 and in a third step 17 further compressing the fluid. The cooling step 17 comprises the step 18 of conveying the fluid via cool fluid. The fluid is conveyed in a tube section 11, as mentioned above, to be cooled by cool fluid in one of the devices 1, 7, 8. Thus the fluid is circulated in the system so that the compressed fluid will later in the process become the cool fluid that cools the fluid. Thereby the system reuses internal energy and temperature differences in the system and no external energy is necessary to add for this particular step. Furthermore the present invention also removes the need of an additional coolant liquid which saves cost. Even further the present invention is more environmental friendly due to this.

Figure 10:
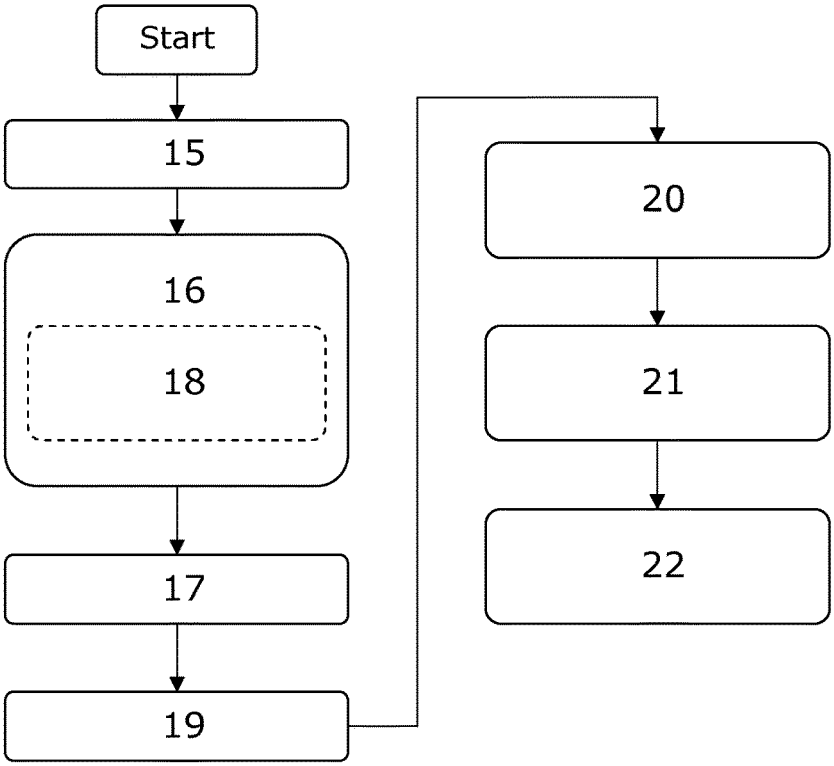
FIG. 10 illustrates further method steps according to the present invention.

FIG. 10 illustrates further steps relating to the method of the present invention. The method comprises the steps of compressing the fluid in a first stage 15, thereafter cooling 16 the fluid and in a third step 17 further compressing the fluid. The cooling step 16 comprises the step 18 of conveying the fluid via cool fluid.

The method may further comprise a second cooling step 19. For example if the compressor unit 14 is a three stage compressor it would be possible to have a further cooling unit 12' (not illustrated) according to the present invention between the second compressor stage 3 and a third compressor stage (not illustrated).

The method may further comprise the step of conveying the fluid to storage, such as the storage device 1. If the system does not comprise a three stage compressor the second cooling step is for example the cooling performed by the cooling unit 6 before the fluid enters the storage device 1.

The fluids stored in the storage device 1 may be used for cleaning, when cleaning is about to start the method may therefore comprise the step of conveying the fluid to cleaning, for example to the cleaning chamber 8 in the figures. When the cleaning is done contaminants needs to be removed from the fluid, this process takes place in the distiller 7, Therefore the method may further comprise the step of conveying the fluid to distillation.

In the above description the term "comprising" does not exclude other elements or steps and "a" or "an" does not exclude a plurality.

Furthermore the terms "include" and "contain" does not exclude other elements or steps.

The invention claimed is:

1. An apparatus for cleaning articles comprising:

a first compressor stage for a first processing of fluid, a second compressor stage for a second processing of the fluid, a first cooling unit arranged between the first and second compressor stages, the first cooling unit being configured to first cool the fluid after the first processing of the fluid, the first cooling unit comprising a storage device and a tube section within or surrounding the storage device, the storage device being configured to store the fluid after a second cooling of the fluid that takes place after the second processing of the fluid, the tube section being configured to convey the fluid from the first compressor stage to the second compressor stage such that the fluid in the tube section is cooled by the fluid in the storage device.

2. An apparatus according to claim 1, wherein the tube section is about 0.2 to about 2 meter long.

3. The apparatus according to claim 1, further comprising a second cooling unit configured to perform the second cooling of the fluid that takes place after the second processing of the fluid.

4. The apparatus according to claim 1, wherein the tube section is immersed in the fluid in the storage device.

5. The apparatus according to claim 1, further comprising a tube configured to convey the stored fluid from the storage device to one or more components of the apparatus for an operation of the apparatus for cleaning articles.

6. A method for cooling fluid being used as a solvent in a dry cleaning system, the method comprising:

first compressing the fluid, first cooling the fluid after the first compressing of the fluid, second compressing the fluid after the first cooling of the fluid, second cooling the fluid after the second compressing of the fluid, storing the fluid for a period of time after the second cooling of the fluid in a storage device, wherein, the first cooling comprises, after the first compressing of the fluid and before the second compressing of the fluid, cooling the fluid by the fluid that is stored, and after passage of the period of time, conveying the stored fluid from the storage device to one or more components of the apparatus for an operation of the apparatus for cleaning articles.

7. A method for cooling fluid according to claim 6, further comprising conveying the fluid after the second compressing of the fluid to a cleaning chamber before the second cooling of the fluid.

8. A method for cooling fluid according to claim 6, further comprising conveying the fluid after the second compressing of the fluid to a distillation vessel before the second cooling of the fluid.

9. A method for cooling fluid according to claim 6, wherein the pressure of the fluid is about 50-70 bar after the second compressing of the fluid.

10. A method according to claim 6, wherein the fluid comprises carbon dioxide.

11. A cooling system comprising:

a compressor unit for sequential compression of a fluid, and a cooling unit for intermediary cooling of the fluid between the sequential compressions, the cooling unit comprising a storage device of cooled fluid and a tube section within or surrounding the storage device being configured to convey fluid between the sequential compressions, the compressor unit and the cooling unit being interlinked in such a way that the intermediary cooling is made by the stored cooled fluid.

12. A cooling system according to claim 11, wherein the compressor unit is at least a two stage compressor.

13. The cooling system according to claim 11, wherein the tube section is immersed in the fluid in the storage device.

14. The cooling system according to claim 11, further comprising a tube configured to convey the stored fluid from the storage device to one or more components of the apparatus for an operation of the apparatus for cleaning articles.

* * * * *